US005316517A

United States Patent [19]

Chiba et al.

[11] Patent Number: 5,316,517

[45] Date of Patent: May 31, 1994

[54] COIN DISPENSING DEVICE

[76] Inventors: Kazumii Chiba, 367-1-401; Clarence Y. T. Cheng, 102 Sunnywell Sankei-en 367-2, both of Honmokumotomachi, Naka-ku, Yokohama-shi, Japan

[21] Appl. No.: 900,930

[22] Filed: Jun. 18, 1992

[30] Foreign Application Priority Data

Oct. 14, 1991 [JP] Japan ..... 3-293561

[51] Int. Cl.[5] ..... G07D 1/00

[52] U.S. Cl. ..... 453/57; 221/203

[58] Field of Search ..... 453/30, 32, 33, 49, 453/57; 221/203, 237

[56] References Cited

U.S. PATENT DOCUMENTS 4,437,478 3/1984 Abe ..... 453/32

5,098,339 3/1992 Dabrowski ..... 453/30

*Primary Examiner*—F. J. Bartuska

*Attorney, Agent, or Firm*—Cushman, Darby & Cushman

[57] ABSTRACT

A coin dispensing device assures dispensing operation of coins while protecting a driving member from overloading. In addition, the coin dispensing device prevents the coins from jamming. The device comprises a mechanism for storing loose coins, a first rotary member associated with a central feed aperture for receiving the loose coin from the loose coin storing mechanism and feeding the loose coin into the central feed aperture in a one-by-one basis, a stationary member for defining an elongated slot associated with the central feed aperture essentially at the inner end thereof for receiving the loose coin fed therethrough, the elongated slot forming a dispensing path for the loose coins fed from the central feed aperture, a second rotary member for pushing out the loose coin in the elongated slot toward a dispensing outlet, the second rotary member carrying a pushing member movable across the elongated slot for exerting feeding force to the loose coin within the elongated slot for pushing out the coin within the elongated slot in one-by-one basis, a driving element for rotatingly driving the first and second rotary members, and a feed mechanism provided in the first rotary member for sweeping the loose coins on the first rotary member into the central feeding aperture.

22 Claims, 13 Drawing Sheets

COIN DISPENSING DEVICE

BACKGROUND OF THE INVENTION

1. Field of the Invention

The present invention relates to a coin dispensing device. More specifically, the invention relates to a coin dispensing device which is suitable for use in an automatic vender machine and so forth for dispensing change.

2. Description of the Related Art

As is well known, various coin dispensing devices have been used. For example, U.S. Pat. No. 3,942,544, to Breitenstein discloses a coin dispensing device for a gaming equipment, such as a slot machine, in which a bowl-shaped hopper is provided on the interior of the gaming machine. Coins inserted by the patron fall into the hopper and become the coin supply to be dispensed in the event that the patron achieves a winning combination of the slot machine. On the back wall of the hopper, there is provided a pin wheel device that rotates through the coin supply and picks up individual coins around the periphery of the pin wheel. As the pin wheel rotates, the coins on the top of the pin wheel are fed along a knife track to a location where each coin exits the interior of the gaming machine and is dispensed into a coin tray for access by the patron. U.S. Pat. No. 4,398,550, to Shireman, discloses a pair of rotating, overlapping disks each with a plurality of coin receiving apertures. The disks rotate in opposite angular directions and coins are transferred from one disk to the other disk when the apertures line up. The axes of the disks are offset in that only one aperture in the upper disk lines up with one aperture in the lower disk so that only one coin dispensed at a time. A coin dispensing device that utilizes the Shireman apparatus must be large enough to accommodate the diameters of each of the two overlapping disks.

Further prior art has been disclosed in U.S. Pat. No. 4,881,919, to Dabrowski, in which an apparatus uses a single rotating disk at the bottom of the hopper. The rotating disk is provided with a plurality of peripheral slot like passages that receive coins from the hopper and then spin the coins off the disk at a particular angular position so that the coins can be dispensed into a coin tray.

In addition to the foregoing, U.S. Pat. No. 32,799, to Abe, U.S. Pat. No. 3,680,566 to Tanaka, U.S. Pat. No. 4,437,478 to Abe, U.S. Pat. No. 4,441,515 to Goepner, U.S. Pat. No. 4,531,531, to Johnson, U.S. Pat. No. 4,534,373, to Glinka, U.S. Pat. No. 4,557,282, to Childers, U.S. Pat. No. 4,681,128, to Ristvedt, U.S. Pat. No. 4,752,274, to Abe, U.S. Pat. No. 4,752,625 to Okada, Asaki Seiko U.S.A. Inc. catalog (Aug. 20, 1989, can be listed as disclosing the relevant prior art. However, it should be noted that the listing of the prior art above should not mean the list is exhaustive and as the result of extensive search. Therefore, the foregoing statement should be appreciated as a disclosure of the prior art presently known to the applicants and the owner of the invention.

Typically, a conventional coin dispensing device includes a loose coil dispensing mechanism which receives the weight of loose coins stored in a coin storage, such as a hopper. In such construction, the accurate operation of the coin dispensing mechanism cannot be assured due to the weight of the coins loaded thereon. In particular, when relatively large amount of coins are stored in the loose coin storage, the operation of the coin dispensing mechanism can become uncertain.

In order to solve the above-mentioned problem, there is a proposal in Japanese Patent Application No. 3-94695 (corresponding to the co-pending U.S. Pat. application Ser. No. 07/645,966, entitled "Coin Dispensing Device", by Stanley P. Dabrowski), in which the coin dispensing mechanism will not directly subject the weight of the coins stored in the coin storage.

In the practical construction disclosed in the above-mentioned co-pending Japanese Patent Application, a coin dispensing device for dispensing loose coins from a coin hopper comprises a base plate, a first rotating disk mounted on the base plate, which first rotating disk has a central feed aperture, a fixed disk mounted to the base plate and beneath the first rotating disk, the fixed disk having a dispensing slot aligned with the central feed aperture, a second rotating disk mounted on the based plate and beneath the fixed disk, the second disk offset from the dispensing slot, and the second rotating disk including at least one pusher ball on the surface thereof cooperating with the dispensing slot, whereby loose coins from the coin hopper are fed into the central feed aperture of the first rotating disk, from which the coins fall into the dispensing slot in the fixed disk and are dispensed down the dispensing slot by the movement of the pusher ball on the second rotating disk and exit the coin dispensing device. The first rotating disk has a supply member. The supply member has an arc shaped side wall which is connected with the first rotating disk in tangential direction at one end. The other end of the arc shaped side wall is terminated at the central feed opening. The arc shaped side wall extends vertically.

The entire disclosure of the above-identified co-pending U.S. Pat. application Ser. No. 07/645,966 is herein incorporated by reference for the sake of disclosure.

However the invention of Dabrowski in the co-pending U.S. Pat. Application as identified above, provides certain improvement for operation of the coin dispensing mechanism by avoiding the load of coin from loading thereon and thus for loose coin dispensing performance, there are still remained problems to be solved.

For instance, in the supply member provided in the first rotating disk, since the arc shaped side wall is oriented vertically, force is exerted on a plurality of coins in a direction of aligning the coins to occasionally cause interlocking of a plurality of coins, when the coins are guided to the central feed aperture from the coin hopper according to counterclockwise direction of the first rotating disk. In such case, smooth rotation of the first rotating disk is interfered so that the coins cannot be guided to the central feed aperture. Although the push ball employed in the second rotating disk as the pushing means is advantageously employed for avoiding excess load to be exerted on the motor for rotatingly driving second rotating disk by the construction in which the push ball is normally biased by a spring to fall onto the fixed disk through the central aperture of the first rotating disk and slides below the coins with depressing the spring downwardly to prevent the excess load from being exerted on the motor when the interlocking of the coins to be dispensed is caused by the action of the push ball, it can make it impossible to dispense the coins by sliding of the push ball below the coins.

SUMMARY OF THE INVENTION

It is an object of the present invention to provide a coin dispensing device which can prevent a plurality of dispensing coins from causing interlocking, as Well as avoiding direct loading of a weight load of the coins in a coin storage to maintain satisfactory level of performance of a coin dispensing mechanism.

Another object of the invention is to provide a coin dispensing device which can avoid overloading of a motor which drives a rotating disk even when jamming of the coins is caused, and as well assuring dispensing of the coins.

In order to accomplish the above-mentioned and other objects, a coin dispensing device, according to one aspect of the present invention, comprises:

means for storing loose coins;

first rotary means associated with a central feed aperture for receiving the loose coin from the loose coin storing means and feeding the loose coin into the central feed aperture in one-by-one basis;

stationary means for defining an elongated slot associated with the central feed aperture essentially at the inner end thereof for receiving the loose coin fed therethrough, the elongated slot forming a dispensing path of the loose coins fed from the central feed aperture;

second rotary means for pushing out the loose coin in the elongated slot toward a dispensing outlet, the second rotary means carrying pushing means movable across the elongated slot for exerting feeding force to the loose coin within the elongated slot for pushing out the coin within the elongated slot in one-by-one basis;

driving means for rotatingly driving the first and second rotary means; and feed means provided in the first rotary member for sweeping the loose coins on the first rotary means into the central feed aperture, the feed means including an arcuate and tapered side wall having variable radial dimension from the first circumferential end having the maximum radial dimension to the second circumferential end having the minimum radial dimension, the taper angle down toward the central feed aperture being increased from the first end to the second end.

In the practical construction, projection means is provided on the surface of the first rotary means receiving thereon the loose coins, the projection means being positioned in the vicinity of the first end of the side wall for agitating the coins for preventing the coins from causing jamming.

Preferably, the center feed aperture has a tapered inner periphery narrowing toward the end opening to the elongated slot. Also, the side wall may substantially extend over the periphery of the central feed aperture to the outer periphery of the first rotary means, at the first end. Preferably, the side wall does substantially extend over the periphery of the central feed aperture to the position located in the vicinity of the outer periphery of the first rotary means, at the first end.

In the construction set forth above, the pushing means may be stationary relative to the second rotary means. The pushing means may comprise at least one projecting pin projected from the second rotary means. In the alternative, the pushing means comprises at least one bar-shaped piece projecting from the second rotary means and extending essentially in radial direction.

Preferably, the second rotary means comprises a first rotary member carrying the pushing means, a second rotary member associated with the driving means to be driven by the driving torque supplied therefrom, and a load responsive clutch means disclosed between the first and second rotary members for normally coupling therebetween for co-rotation and responsive to a load higher than a predetermined value for decoupling therebetween.

According to another aspect of the invention, a coin dispensing device comprises:

a coin hopper for storing loose coins therein, the coin hopper defining a bottom opening for supplying the loose coins therethrough;

first rotating disk disposed beneath the bottom opening of the coin hopper, the first rotating disk having an upper surface for receiving a plurality of loose coins supplied through the bottom opening of the coin hopper, the first rotating disk defining a central feed aperture extending substantially in vertical direction for passing the loose coin therethrough, the first rotating disk further defining a tapered surface extending in circumferential direction and descending toward the central feed aperture in a part of the supper surface, the tapered surface being terminated with a vertically extending section at one end;

a fixed disk having an upper surface defining a horizontally extending coin dispensing path which has the inner end opposing to the lower end of the central feed aperture of the first rotating disk and the outer end opening to a coin dispensing outlet;

a second rotating disk located beneath the fixed disk and carrying at least one pushing member travelling across the coin dispensing path defined in the fixed disk for exerting feeding force to the loose coin therein for feeding toward the coin dispensing outlet; and a driving means for rotatingly driving the first and second rotating disk.

Preferably, the tapered surface of the first rotating disk is variable of the taper angle relative to the horizontal place so that the taper angle is increased from the one end to the other end. The other end of the tapered surface may be substantially continuous to inner periphery of the center feed aperture. The center feed aperture may also have the tapered inner periphery to have the largest diameter at the upper end and the smallest diameter at the lower end.

In the further preferred construction, the coin dispensing device may further comprise a projection detecting from the upper surface of the first rotating disk, the projection having at least one sloped surface oriented in the circumferential direction. In such case, the projection is radially positioned in the vicinity of the peripheral edge of the center feed aperture. Further preferably, the projection is positioned in the vicinity of the one end of the tapered surface, and directed the sloped surface to the one end of the tapered surface so that the sloped surface of the projection terminates at the upper edge of the vertical section.

For assuring dispensing operation, the pushing member is preferred to be rigidly fixed to the second member for rotation therewith. In such case, it is preferred that the second rotating disk comprises a first upper disk carrying the pushing member rigidly fixed thereto, a second lower disk coupled with the driving means to be rotatingly driven by the driving torque transmitted therefrom, and a mechanical clutch disposed between the first upper and second lower disks for normally coupling therebetween for co-rotation and responsive to an excess load exerted on the first upper disk to decouple the first upper and second lower disk to permit slipping rotation of the second lower disk relative to the first upper disk. Preferably, the mechanical clutch comprises a waving washer disposed between the first upper and second lower disks, which establishes frictional engagement therebetween.

According to a further aspect of the invention, a coin dispensing device comprises:

a coin hopper for storing loose coins therein, the coin hopper defining a bottom opening for supplying the loose coins therethrough;

first rotating disk disposed beneath the bottom opening of the coin hopper, the first rotating disk having an upper surface for receiving a plurality of loose coins supplied through the bottom opening of the coin hopper, the first rotating disk defining a central feed aperture extending substantially in vertical direction for passing the loose coin therethrough;

a fixed disk having an upper surface defining a horizontally extending coin dispensing path which has the inner end opposing to the lower end of the central feed aperture of the first rotating disk and the outer end opening to a coin dispensing outlet;

a second rotating disk located beneath the fixed disk and carrying at least one pushing member rigidly fixed thereon and travelling across the coin dispensing path defined in the fixed disk for exerting feeding force to the loose coin therein for feeding toward the coin dispensing outlet, the second rotating disk including a first upper disk carrying the pushing member rigidly fixed thereto, a second lower disk coupled with the driving means to be rotatingly driven by the driving torque transmitted therefrom, and a mechanical clutch disposed between the first upper and second lower disks for normally coupling therebetween for co-rotation and responsive to an excess load exerted on the first upper disk to decouple the first upper and second lower disk to permit slipping rotation of the second lower disk relative to the first upper disk; and a driving means for rotatingly driving the first and second rotating disk.

According to a still further aspect of the invention, a coin dispensing device comprises:

a coin hopper for storing loose coins therein, the coin hopper defining a bottom opening for supplying the loose coins therethrough;

first rotating disk disposed beneath the bottom opening of the coin hopper, the first rotating disk having an upper surface for receiving a plurality of loose coins supplied through the bottom opening of the coin hopper, the first rotating disk defining a central feed aperture extending substantially in vertical direction for passing the loose coin therethrough, the first rotating disk further defining a tapered surface extending in circumferential direction and descending toward the central feed aperture in a part of the upper surface, the tapered surface being terminated with a vertically extending section at one end;

a fixed disk having an upper surface defining a horizontally extending coin dispensing path which has the inner end opposing to the lower end of the central feed aperture of the first rotating disk and the outer end opening to a coin dispensing outlet;

a second rotating disk located beneath the fixed disk and carrying at least one pushing member rigidly fixed thereon and travelling across the coin dispensing path defined in the fixed disk for exerting feeding force to the loose coin therein for feeding toward the coin dispensing outlet, the second rotating disk including a first upper disk carrying the pushing member rigidly fixed thereto, a second lower disk coupled with the driving means to be rotatingly driven by the driving torque transmitted therefrom, and a mechanical clutch disposed between the first upper and second lower disks for normally coupling therebetween for co-rotation and responsive to an excess load exerted on the first upper disk to decouple the first upper and second lower disk to permit slipping rotation of the second lower disk relative to the first upper disk; and a driving means for rotatingly driving the first and second rotating disk.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENTS

Detail of a coin dispensing device according to the present invention, incorporating the preferred embodiment of coin dispensing mechanisms will be discussed herebelow with reference to the accompanying drawings.

Figure 1:
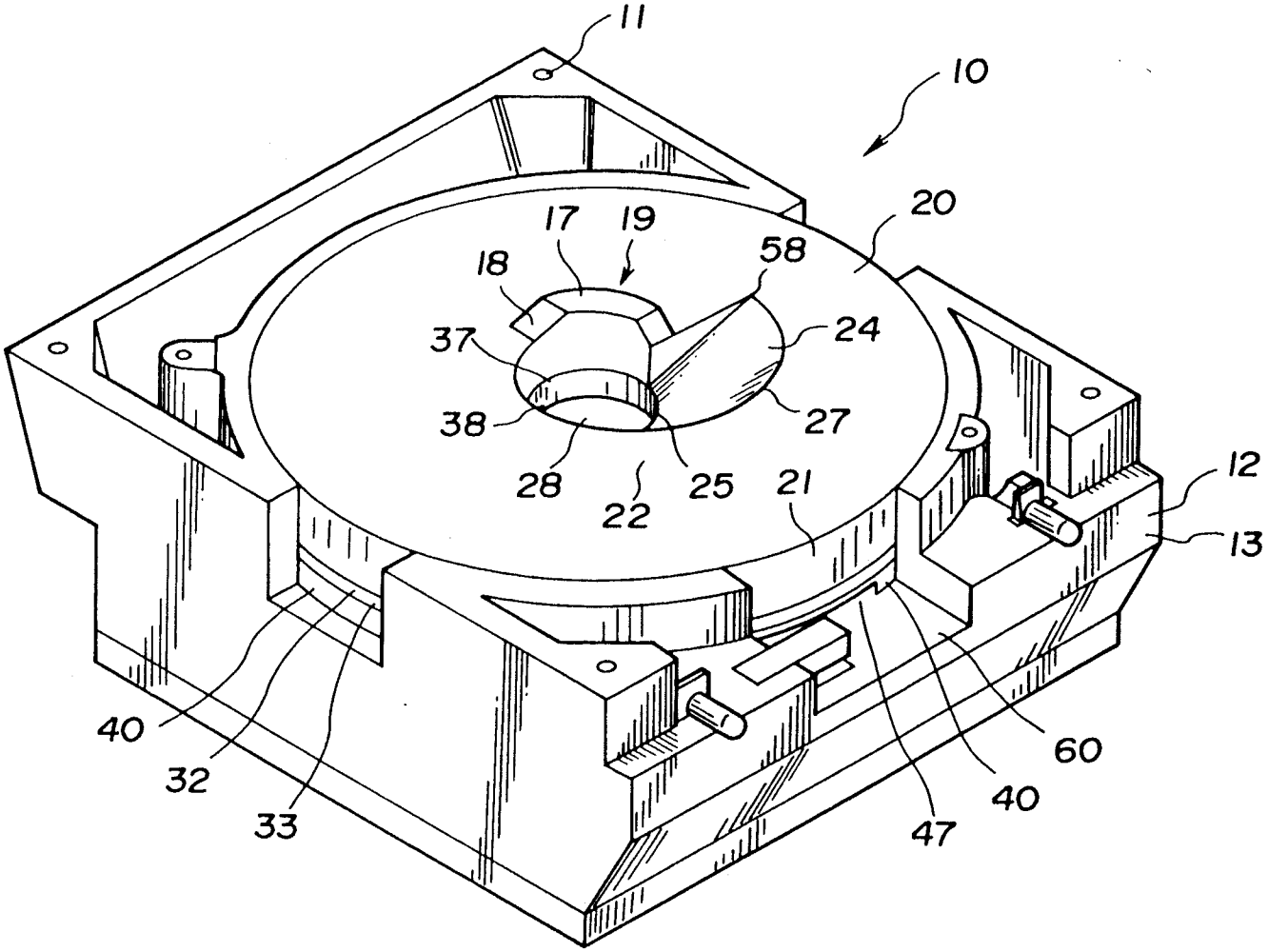
FIG. 1 is a perspective view of the preferred embodiment of a coin dispensing mechanism employed in a coin dispensing device according to the present invention.
Figure 2:
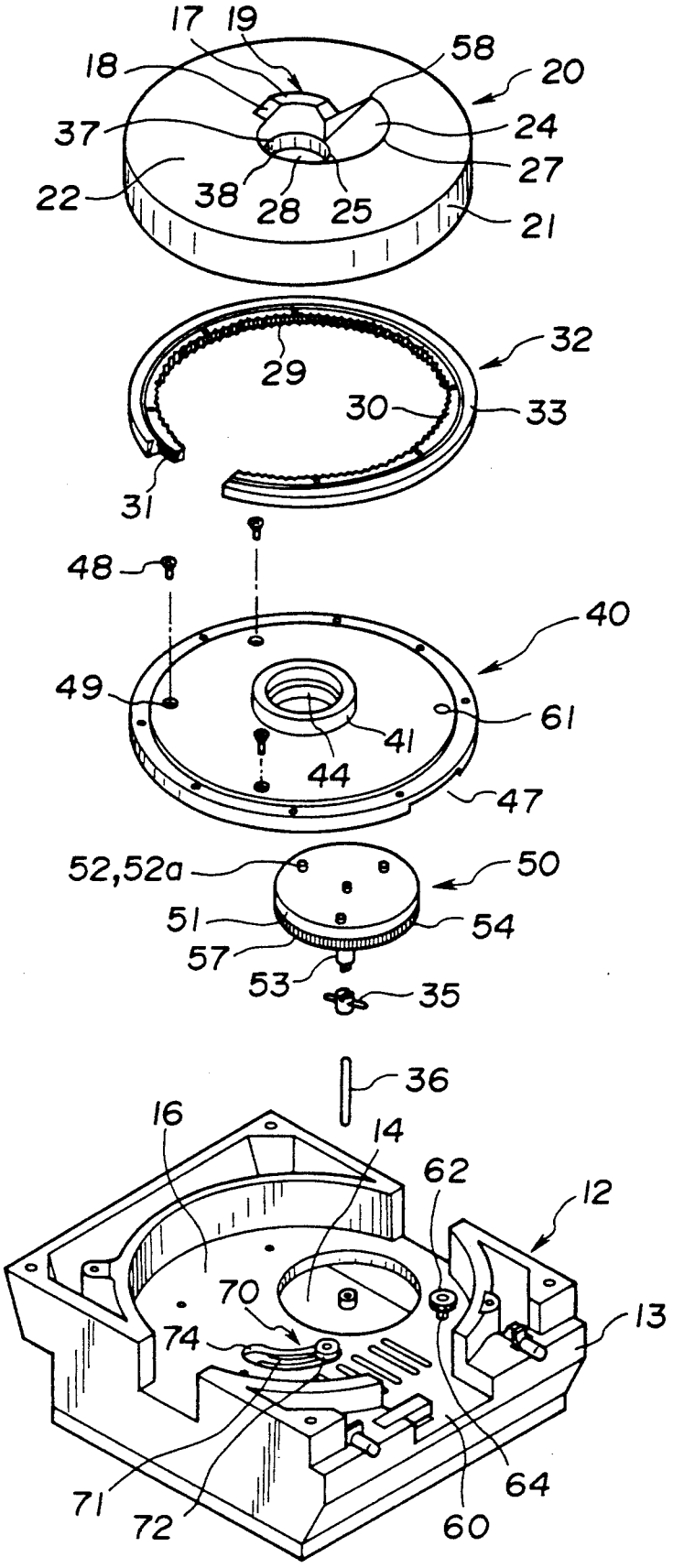
FIG. 2 is an exploded perspective view of the preferred embodiment of the coin dispensing mechanism of FIG. 1.

Referring now to the drawings, particularly to FIGS. 1 and 2, the preferred embodiment of a coin dispensing mechanism 10 has a square or rectangular base plate 12 which has a front end face 13. The base plate 12 defines an upwardly opened upper cavity 16 which receives operational elements of the coin dispensing mechanism including a first rotating disk 20 and a fixed disk 40. The base plate 12 further defines a lower cavity 14 in a part of the bottom of the upper cavity 16, for receiving a second rotating disk 50.

The base plate 12 also defines a coin hopper mounting ports 11 at respective corners so that a coin hopper 90 (shown by phantom line in FIG. 3) as a coin storage means can be connected therethrough. The coin hopper 90 can be of any appropriate configuration depending upon a desired overall configuration of the coin dispensing device. The coin hopper 90 has an open bottom directly in communication with the upper portion of the base plate 12. The coin hopper 90 may be rigidly fixed to the base plate 12 by means of fastening screws threadingly engaged to the coin hopper mounting ports 11 or posts pressed into the ports 11. The coin dispensing mechanism 10 is designed to withdraw coins 75 stored in the coin hopper 90 directly through the bottom of the hopper.

An opening serving as an outlet slot 60 for the dispensed coin 75 is formed through the front face 13 of the base plate 12. Although a coin tray (not shown) is provided in the vicinity of the outlet slot 60 in the per se known manner and known position relative to the slot so as to receive the dispensed loose coins.

FIG. 2 shows the detail of the operational elements of the preferred embodiment of the coin dispensing mechanism 10. The first rotating disk 20, a bearing runner 32, a fixed disk 40 and the second rotating disk 50 are received within the upper and lower cavities 16 and 14 of the base plate 12 in stacking manner.

The first rotating disk 20 is a generally cylindrical member. A feeding member 22 is provided on the first rotating disk 20. The feeding member 22 has an arcuate side wall 24 which extends essentially in the circumferential direction. As can be seen from FIG. 2, the radius of the curvature of the arcuate side wall is reduced from one end to the other end so that one end of the arcuate side wall 24 is terminated at the maximum radius position close to the outer peripheral wall and the other end of the arcuate side wall 24 is terminated at the minimum radius position corresponding to a central feed aperture 28. The central feed aperture 28 is defined through the center portion of the first rotating disk 20 and has a diameter approximately equal to or slightly greater than a diameter of the coins 75 to be dispensed.

Figure 9:
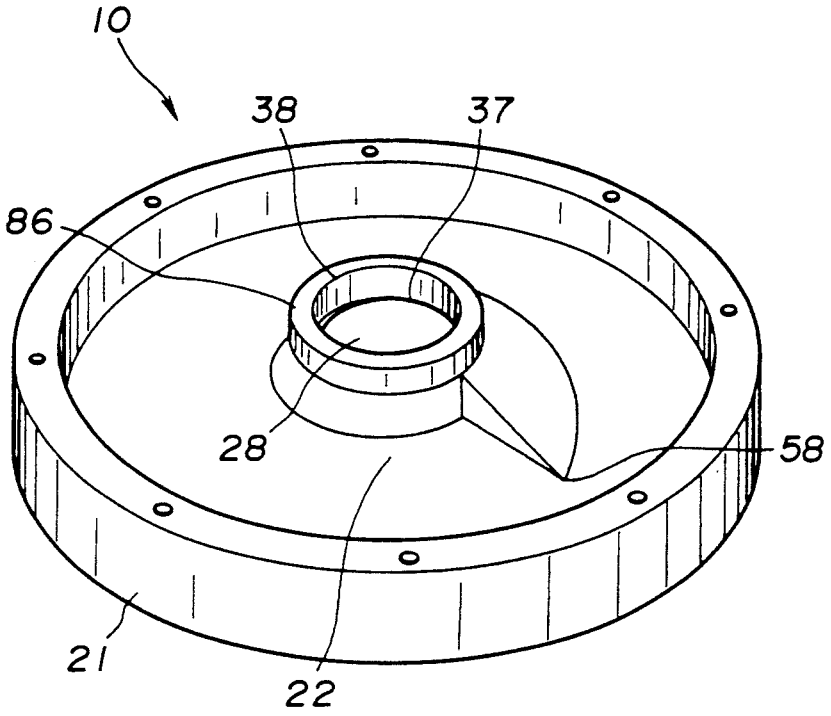
FIG. 9 is a perspective view of the first rotating disk situated in up-side-down condition for showing the construction at the bottom thereof.

As can be seen from the perspective bottom view of FIG. 9, the first rotating disk 20 has a cylindrical downward extension 86 which defines a coin path of the central feed aperture 28. The extension 86 is extended from the center portion of the bottom surface of the first rotating disk 20.

The bearing runner 32 is disposed between the first rotating disk 20 and the fixed disk 40. The bearing runner 32 has a gear ring 30 having internal gear teeth 29, and a stationary ring 33. The gear ring 30 is coupled with the stationary ring 33 through a ball bearing 31 disposed therebetween, so that the gear ring 30 is rotatable relative to the stationary ring 33.

Figure 7:
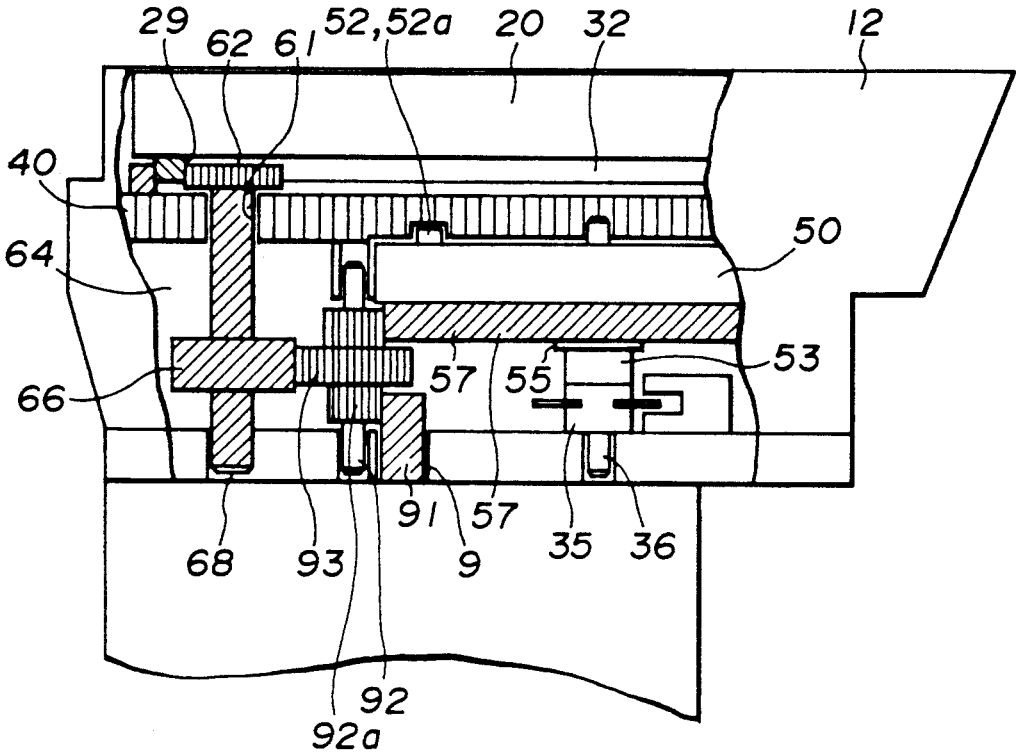
FIG. 7 is a partial section of the major part of the preferred embodiment of the coin dispensing mechanism.

The fixed disk 40 is arranged between the first rotating disk 20 interpositioning the bearing runner 32 therebetween. The fixed disk 40 is generally disc shaped plane plate member. The fixed disk 40 is formed with a plurality of screw openings 49 to receive fastening screws 48 or any other appropriate means so that it may be secured at the predetermined position within the upper cavity 16 by means of the fastening screws 48 or other appropriate means. On the other hand, the fixed disk 40 defines a mounting post receptacle opening 61 for receiving a mounting post 64 extending upwardly from a gear shaft 68, as shown in FIG. 7. Furthermore, at the center of the fixed disk 40, a cylindrical extension 41 is formed. The cylindrical extension 41 is aligned with the downward extension 86 of the first rotating disk 20 to define a coin path in cooperation therewith. A dispensing slot plate 44 is provided on the lower center portion of the fixed disk 40. The dispensing slot plate 44 extends toward a dispensing slot 46 opening at the lower end of the coin path defined by the extension 41 and defines a dispensing slot 47 located at the outer periphery of the fixed disk 40.

In assembling of the first rotating disk 20, the bearing runner 32 and the fixed disk 40, the fixed disk 40 is, at first, fixed at the predetermined position within the upper cavity 16 of the base plate 12. Then, the stationary ring 33 of the bearing runner 32 is fixedly secured on the fixed disk 40. The gear ring 30 is the bearing runner 32 is fixedly secured to the first rotating disk 20.

The second rotating disk 50 is located beneath the fixed disk 40. The second rotating disk 50 is disposed within the lower cavity 14 of the base plate 12 for rotation about a disk shaft 53 which will be discussed later. The second rotating disk 50 is a generally cylindrical member including an upper plate 51 and a lower plate 54. Gear teeth 57 is formed on the outer periphery of the lower plate 54. On the other hand, first and second mounting members 35 and 36 are connected to the disk shaft 53 for mounting the second rotating disk 50 within the lower cavity 14 as set forth above.

Figure 8:
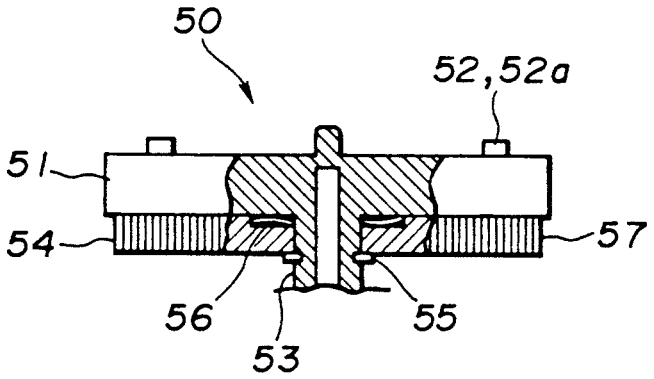
FIG. 8 is a partial section showing the second rotating disk in the preferred embodiment of the coin dispensing mechanism.

Furthermore, on the upper surface of the second rotating disk 50, at least one pushing means 52 in a form of projection is formed in the vicinity of the outer circumference thereof. The pushing means 52 is cooperative with the coin dispensing slot 47 for dispensing the loose coin therethrough. The pushing means 52 is stationary relative to the second rotating disk 50 for pushing the coin 75 in aligned coins and located at the corresponding position accessible by the pushing means 52 for feeding the coin one-by-one toward the coin dispensing slot 47. (see FIGS. 2 and 8)

The base plate 12 incorporates a coin actuator assembly 70 on the bottom of the upper cavity 16. The coin actuator assembly 70 comprises a coin actuator arm 71 placed beneath the bottom wall of the upper cavity 16 and pivotable about a pivot (not shown) and a roller 72 mounted on the free end of the coin actuator arm 71. The roller 72 extends through an arcuate slot 74 formed in the bottom wall of the upper cavity 16. The coin actuator arm 71 is so designed as to be pivotally driven with carrying the roller 72 to shift the latter along the actuated slot 74 in synchronism with the loose coin dispensing action. In practice, the coin actuator arm 71 performs one cycle of action every time one loose coin 75 is dispensed through the coin outlet slot 60. The coin actuator assembly 70 is also operative for counting number of dispensed coins 75.

Figure 3:
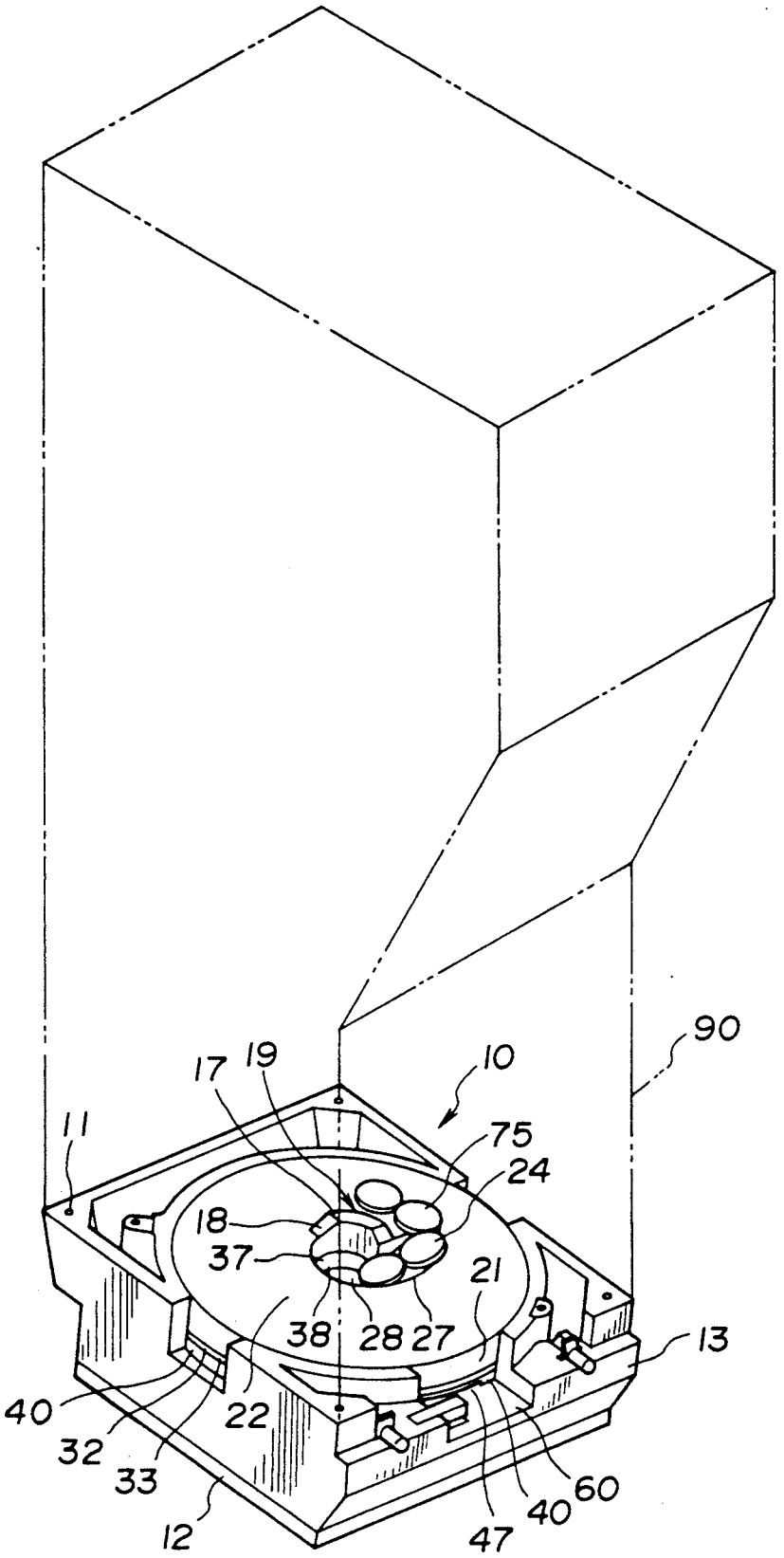
FIG. 3 is a perspective view of the preferred embodiment of the coin dispensing mechanism which is situated for use in combination with a coin hopper as a coin storage means, illustrated by phantom line.

As shown in FIG. 3, the coin tray (not shown) is provided in the vicinity of the coin outlet slot 60 in per se well known manner. The capacity of the coin tray to receive the loose coins 75 dispensed through the coin outlet slot 60 can be appropriately selected by adjusting the size of a coin receptacle cavity defined therein. On the other hand, the coin dispensing mechanism 10 is placed at the bottom of the housing of the coin dispensing device, which defines the coin hopper 90 to store therein the loose coins 75 to be dispensed. As shown, the coin dispensing mechanism 10 is disposed within a housing of the coin dispensing device at substantially horizontal position. In the alternative, the coin dispensing mechanism 10 may be installed within the housing of the coin dispensing device in a tilted fashion to lower the front end side where the coin outlet slot 60 is formed than the opposite end. In such case, the preferred tilting angle of the coin dispensing mechanism 10 is less than or equal to 30° with respect to the reference horizontal plane.

As shown in FIG. 7, there is illustrated a drive mechanism for driving the first and second rotating disks 20 and 50. In the illustrated embodiment, the drive mechanism is designed for rotatingly driving the first and second rotating disks 20 and 50 in synchronism with each other. The drive mechanism includes a motor (not shown) mounted beneath the base plate 12. A motor shaft 9 has a tip end, on which gear teeth 91 is formed. The motor shaft 9 extends into the interior space of the base plate 12. A smaller diameter transmission gear 92*a* is supported by a gear shaft 92. The smaller diameter transmission gear 92*a* is meshed with the gear teeth 91 on the motor shaft 9 to be rotatingly driven by the output torque of the motor transmitted therethrough. A larger diameter transmission gear 93 is located at the axially intermediate position of the smaller diameter transmission gear 92. The upper portion of the smaller diameter transmission gear 92 located above the larger diameter section is meshed with gear teeth 57 formed on the outer periphery of the second rotating disk 50 for transmitting the driving torque of the motor.

On the other hand, the gear shaft 68 carries a transmission gear 66 which meshes with the larger diameter transmission gear 93 to be transmitted the driving torque therethrough. As set forth above, the mounting post 64 is extended upwardly from the transmission gear 66 in alignment with the gear shaft 68. The mounting post 64 has the tip end formed into a polygon cross section so as to be received in the drive gear 62 for preventing relative angular displacement between the mounting post 64 and the drive gear 62. As set forth above, the mounting post 64 extends through the opening 61 formed through the bottom wall of the upper cavity 16. The drive gear 62 is meshed with the internal gear teeth 29 of the gear ring 30 of the bearing runner 32.

When the motor is driven for dispensing the loose coin 75, the motor shaft 9 is driven to rotate carrying the smaller and larger diameter transmission gears 92 and 93. By the rotation of the smaller diameter transmission gear 92, the second rotating disk 50 is driven to rotate to push the loose coins 75 aligned toward the coin outlet slot 60 by means of the pushing means 52 carried therewith. Simultaneously, the larger diameter transmission gear 93 drives the transmission gear 66 together with the mounting post 64 and the drive gear 62. By the rotation of the drive gear 62, the gear ring 30 of the bearing runner 32 is driven to rotate together with the first rotating disk 20.

In the construction set forth above, the weight of the loose coins 75 stored in the coin hopper 90 is supported by the first rotating disk 20. Therefore, the second rotating disk 50, the dispensing slot 47 and the coin outlet slot 60 are free from the weight of the loose coins 75 in the coin hopper 90. Namely, these elements, i.e. the second rotating disk 50, the dispensing slot 47 and the coin outlet slot 60 are operative without receiving any influence of the weight of the stored loose coins 75. This contributes for protecting the second rotating disk 50 and relevant elements as set forth above, from causing wearing or being damaged due to the weight of the stored loose coins 75 in the coin hopper 90.

It should be noted that the construction set out above is similar to that disclosed in the co-pending U.S. Pat. application Ser. No. 07/645,966 set forth above. The disclosure of the above-identified co-pending U.S. Pat. application is herein incorporated by reference for the sake of disclosure.

Discussion will be given herebelow for the feature of the present invention. The particular feature of the present invention resides on the construction of the feeding member 22 of the first rotating disk 20 and the pushing means 52 of the second rotating disk 50.

Figure 10:
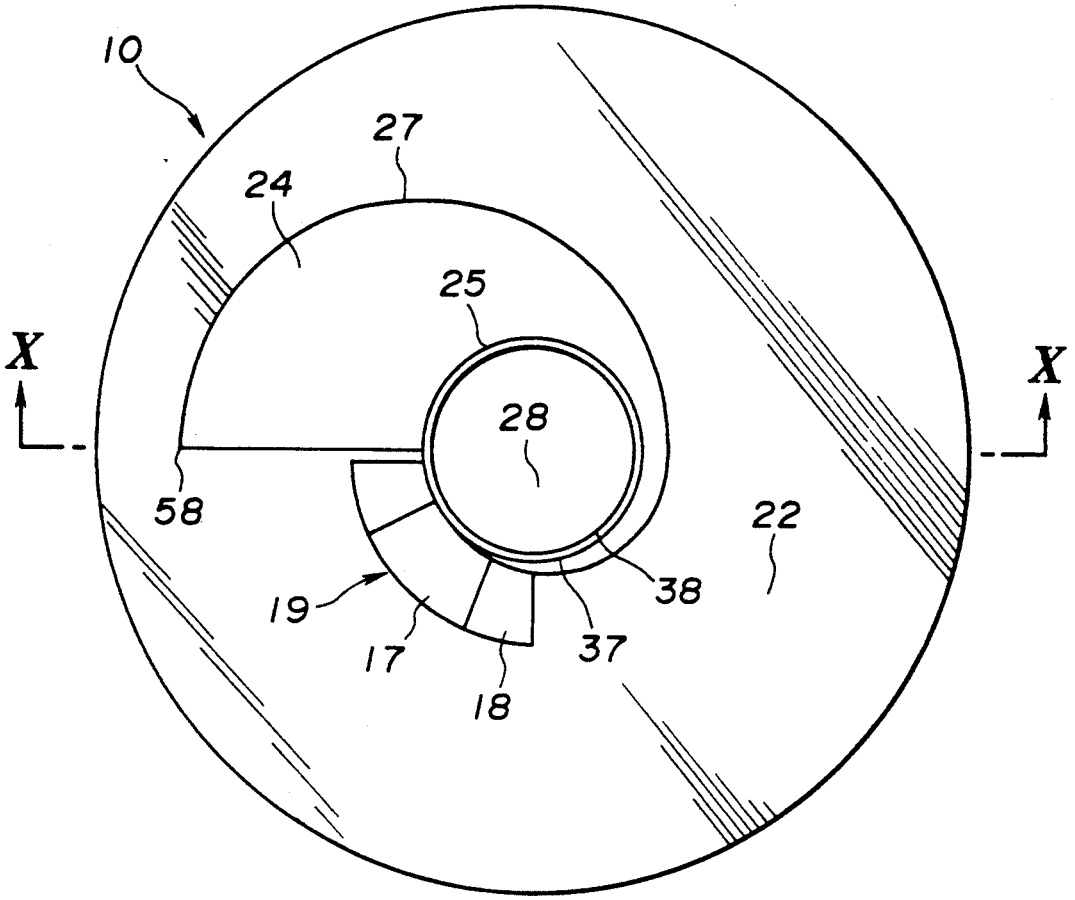
FIG. 10 is a plan view of the first rotating disk in the preferred embodiment of the coin dispensing mechanism.
Figure 11:
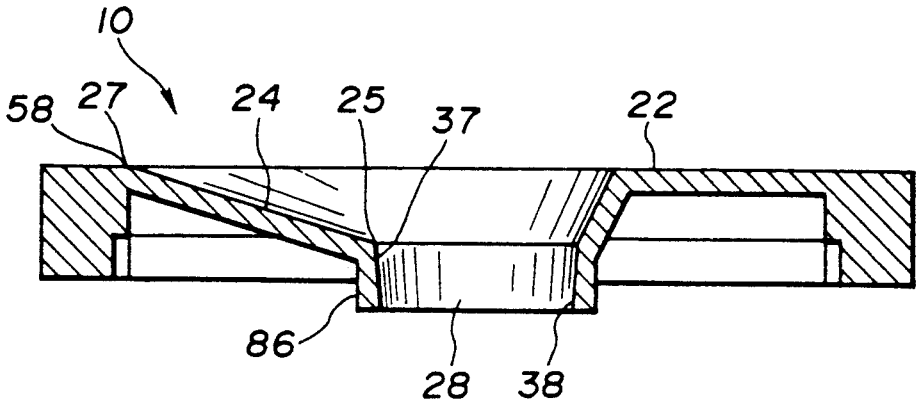
FIG. 11 is a longitudinal section of the first rotating disk taken along line X - X of FIG. 10.
Figure 12:
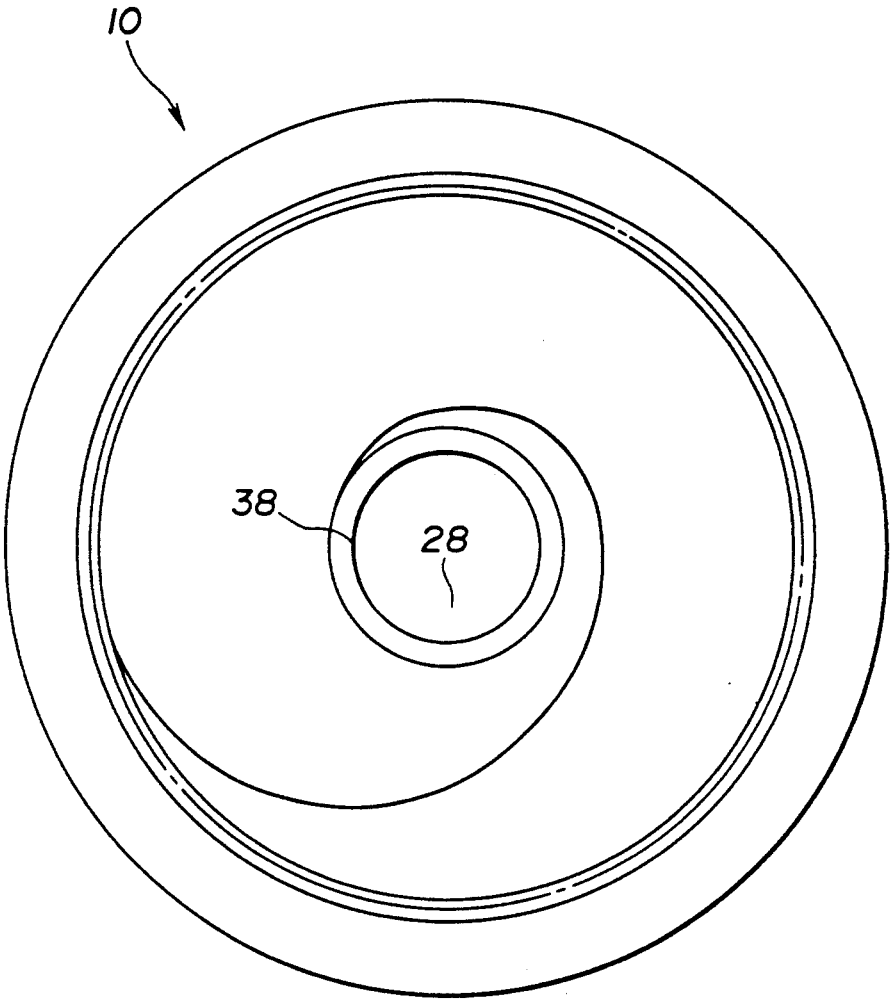
FIG. 12 is a bottom view of the first rotating disk in the preferred embodiment of the coin dispensing mechanism.

The arcuate side wall 24 of the feeding member 22 of the first rotating disk 20 is formed as a tilted wall tilting relative to the horizontal plane. The tilt angle of the arcuate side wall 24 is increased in the clockwise direction according to reduction of the radius, as can be clearly seen from FIGS. 10 and 11. Therefore, the radial dimension between an outer shoulder 27 and an inner shoulder 25 of the actuated side wall 24 is gradually reduced in the clockwise direction. The outer edge 58 at the position where the arcuate side wall 24 is terminated, is positioned close proximity with the circumferential wall 21 of the first rotating disk 20.

At least one pushing means 52 provided for cooperation with the dispensing slot 47. As set forth, the pushing means 52 is rigidly fixed to the second rotating disk 50 and extends from the upper surface of the latter. As illustrated, the pushing means 52 may be a fixed pin 52*a* projecting from the upper surface of the second rotating disk 50. Between the upper and lower plates 51 and 54 of the second rotating disk 50, a waving washer 56 is disposed. Therefore, the upper and lower plates 51 and 54 of the second rotating disk 50 are held in contact with each other with disposing the waving washer 56 therebetween. The upper plate 51 has a center cylindrical extension 53 extending axially downward from the lower surface thereof. The cylindrical extension 53 is coupled with the first and second mounting members 35 and 36. A snap ring 55 is engaged onto the outer periphery of the cylindrical extension 53 so as to restrict axial motion of the lower plate 54 relative to the upper plate 51 so as to maintain the upper and lower plates 51 and 54 in coupled state.

Furthermore, on the plane upper surface of the first rotating disk 20, an arcuate projection 19 with a plane portion 17 and a tapered portions 18 at both ends of the plane portion is formed. One of the tapered portion 18 at one side of the plane portion 17 is terminated at the terminating edge of the actuated side wall 24 of the feeding member 22.

The central feed aperture 28 of the first rotating disk 20 has a tapered side wall so that the diameter of the central feed aperture 28 is reduced from the upper edge 37 to the lower edge 38. The diameter at the lower edge 38 of the central feed aperture 28 is selected to be slightly greater than or essentially equal to the diameter of the individual coin 75 to be dispensed.

Figure 4:
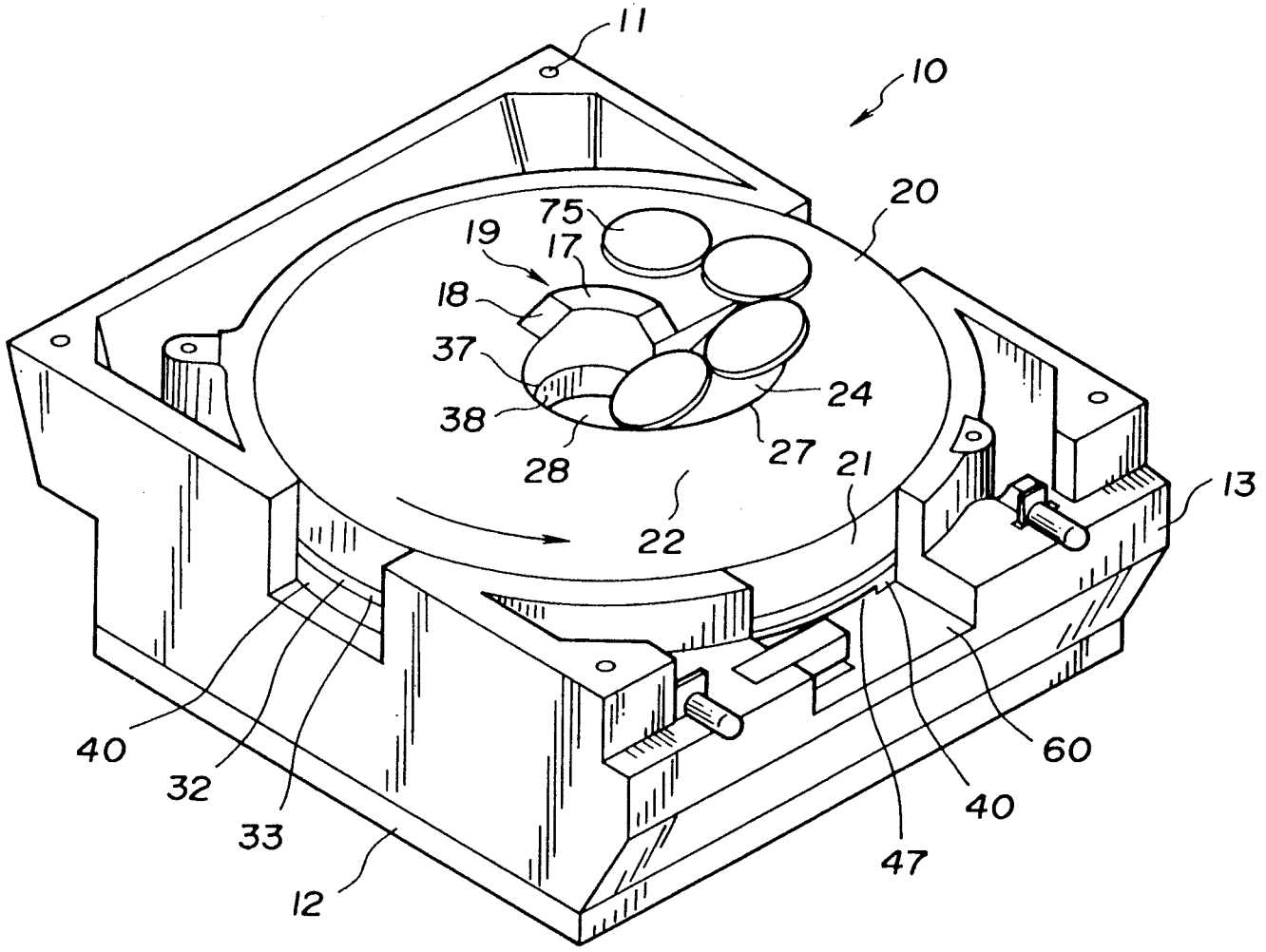
FIG. 4 is a perspective view of the preferred embodiment of the coin dispensing mechanism in an operating condition, in which coins are mounted on a first rotating disk.
Figure 5:
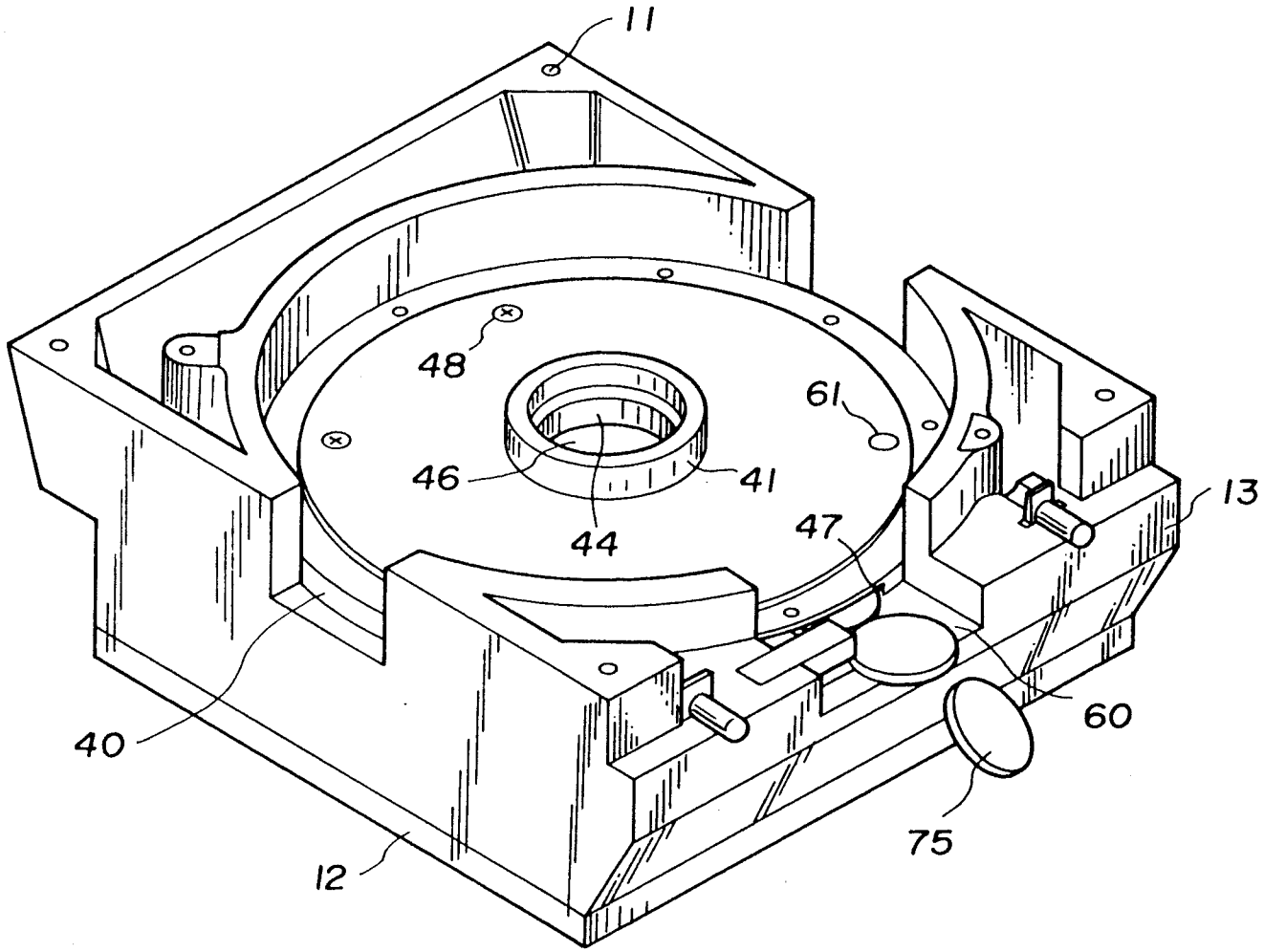
FIG. 5 is a perspective view similar to FIG. 4, but shown with the first rotating disk omitted, and showing the operating condition of the coin dispensing mechanism, in which coins are set in a dispensing slot of a fixed disk for getting ready to dispense the loose coins.

The operation of the coin dispensing mechanism 10 as set forth above will be discussed with reference to FIGS. 4, 5 and 6. As shown in FIG. 4, from the coin hopper 90, a plurality of the loose coins 75 are fed to the feeding means 22 of the first rotating disk 20 by gravity. The first rotating disk 20 is driven in the counterclockwise direction (in a direction shown by the arrow in FIG. 4). By rotation of the first rotating disk 20, the loose coins 75 on the first rotating disk 20 are agitated and swept by the feeding member 22 into the central feed aperture 28. This sweeping actin is effected by the arcuate side wall 24 extending substantially in spiral fashion as set forth above. Since the actuated side wall 24 of the feeding member 22 extends toward the central feed aperture 28 with increasing the tilt angle and decreasing the radial length, all of the loose coins 75 fallen onto the first rotating disk 20 can be certainly guided into the central feed aperture 28.

Discussion will be given with respect to FIG. 5. It should be noted that, for the purpose of illustration, the first rotating disk 20 and the bearing runner 32 are removed from in FIG. 5. As the coins 75 fall through the central feed aperture 28 of the first rotating disk 20, each of coins ends up in the dispensing slot 46 defined by the dispensing slot plate 44. The underside of each coin 75 lines partly on the surface of the upper cavity 16 and partly on the top surface of the second rotating disk 50.

The dispensing slot 46 has an arc-shaped inner end edge area and has a diameter substantially equal to the coin 75 to be dispensed. Such construction of the dispensing slot 46 contributes for aligning the loose coins 75 to be dispensed. The dispensing slot 46 is continuous slot opening to the coin outlet slot 60 via the dispensing slot 47. Such arrangement is effective for lining up the coins 75 in a row in the dispensing slot 46 as shown in FIG. 5.

Figure 6:
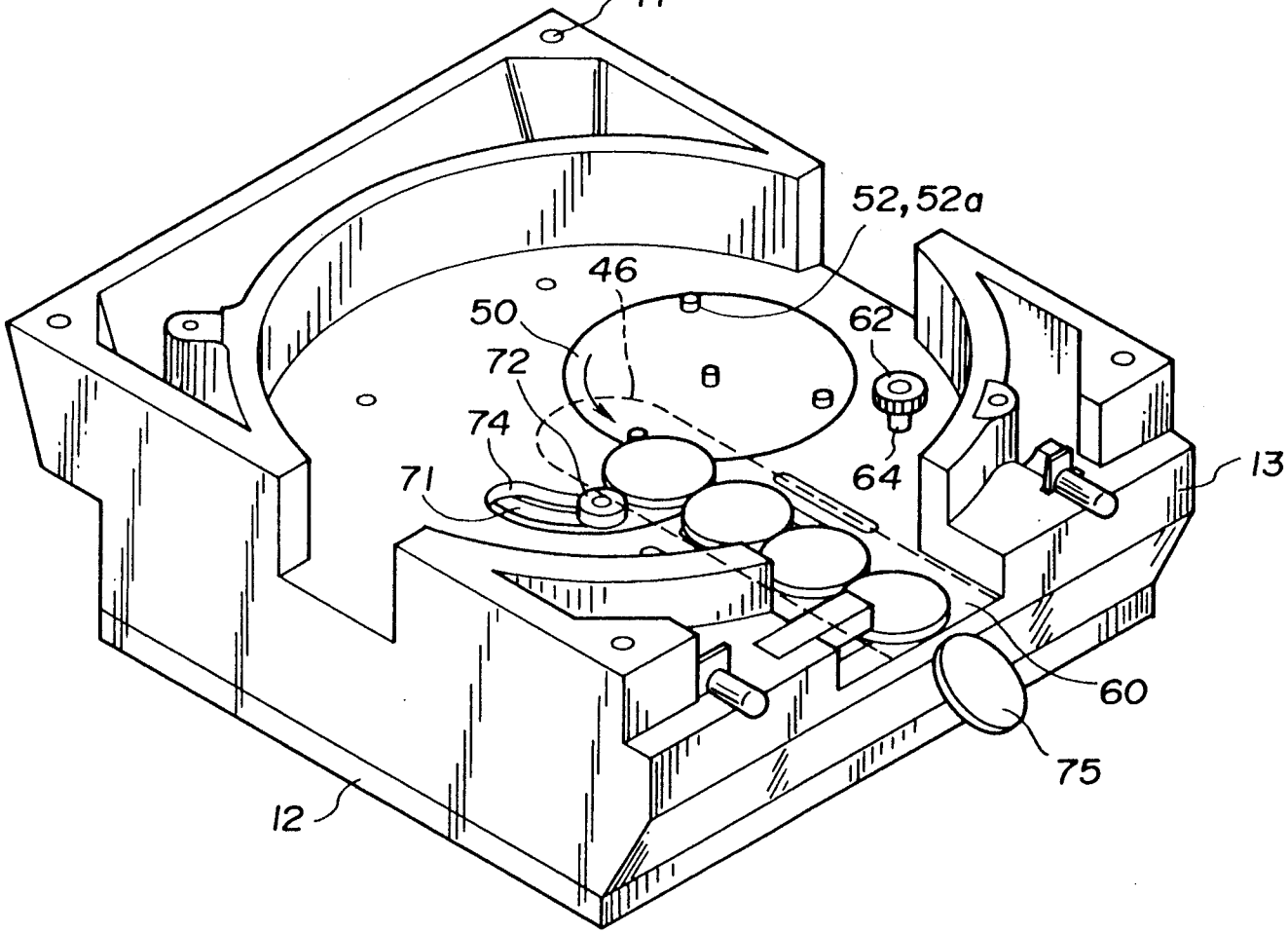
FIG. 6 is a perspective view similar to FIG. 4 but shown with the first rotating disk and the fixed disk omitted, and showing the operating condition, in which a second rotating disk is in operation for dispensing coins through a dispenser outlet opening.

FIG. 6 shows the coin dispensing mechanism 10 with the fixed disk 40 further removed for the purpose of illustration. The coins 75 are lined up in the location where the dispensing slot 46 (shown in phantom line) would be. The second rotating disk 50 is positioned in the lower cavity 14 in the base plate 12 in an offset position relative to the fixed disk 40. As the second rotating disk 50 rotates about the disk shaft 53, the outer periphery of the second rotating disk 50 moves counterclockwise (as shown by the arrow in FIG. 6) and underneath the row of coins 75. The stationary pushing pins **52*a* on the upper surface of the second rotating disk 50 in the vicinity of the outer periphery thereof, contacts with the coin 75 positioned at the innermost end position in the dispensing slot 46. According to rotation of the second rotating disk 50, the pushing pin 52*a* displaces with pushing the innermost coin 75 in the coin train toward the coin outlet slot 60. By this action, the outermost coin 75 positioned closest to the coin outlet slot 60 is pushed out of the outlet slot 60** and thus dispensed into the coin tray. Therefore, the patron becomes accessible to the dispensed coin.

As the second rotating disk 50 rotates, each of the pushing pins **52*a* in turn comes into contact with the edge of the innermost coin 75 in the line-up of the coins in the dispensing slot 46. The pushing pins 52*a* are designed to be driven to rotate together with the second rotating disk 20 by the driving torque of the motor. At the occasion that jamming of the coin within the dispensing slot 46 or at the coin outlet slot 60 to require excessive driving force to drive the coin 75 forward, and when the driving torque exerted on the second rotating disk 20 grows to be greater than or equal to a predetermined value, the resilient force of the waving washer 56 is overcome by the excess torque exerted on the second rotating disk 50 to permit slipping between the upper and lower plates 51 and 54. Therefore, the lower plate 54 to which the driving torque of the motor is transmitted through the gear train of the smaller diameter transmission gear 92 and the gear teeth 57 on the outer periphery of the lower plate 54, is decoupled with the upper plate 51. Therefore, the lower plate 54 is driven to rotate while maintaining the upper plate 51** in stationary state. This arrangement successfully prevent the motor from subjecting excessive load.

Therefore, in the illustrated construction, the loose coin 75 can be dispensed only when both of the first and second rotating disks 20 and 50 are driven to rotate at the normal state.

In the illustrated construction, the arcuate projection 19 having the plane center portion 17 and the tapered portions 18 are provided for causing agitating of the coins 75 on the first rotating plate 20 so as not to cause jamming of the coins. Namely, while the first rotating disk 20 rotates, the coins 75 stacked in the vicinity of the end of the actuated side wall 24 having the greatest radial dimension, which can otherwise causing jamming to make the first rotating disk 20 inoperative by causing interlocking with the bottom wall of the coin hopper or the circumferential wall of the base plate 12, slides along the tapered portion 18 of the arcuate projection 19 to be appropriately dispersed for avoiding possibility of causing jamming.

In addition, the tapered peripheral wall of the central feed aperture 28 is effective for placing the attitude of the coin within the aperture in horizontally oriented position. That is, when the peripheral wall of the central feed aperture 28 is oriented substantially vertical, the coin 75 may fall in the central feed aperture 28 with maintaining its vertically oriented attitude. This makes feeding of coins through the central feed aperture impossible because such a vertically oriented coin may stay in the central feed aperture without being placed in the dispensing slot 46. With the tapered peripheral wall, the coin 75 falling into the central feed aperture, may contact with the peripheral wall to gradually correct its attitude into horizontal orientation. Therefore, the tapered peripheral wall of the central feed aperture 28 contributes for assuring continuous feeding of the coins 75 to the dispensing slot 46.

Next, modifications of the first and second rotating disks 20 and 50 will be discussed. It should be noted that the common or similar elements to the foregoing preferred embodiment will be represented by the same reference numerals and detailed discussion will be neglected for simplicity of disclosure.

Figure 13:
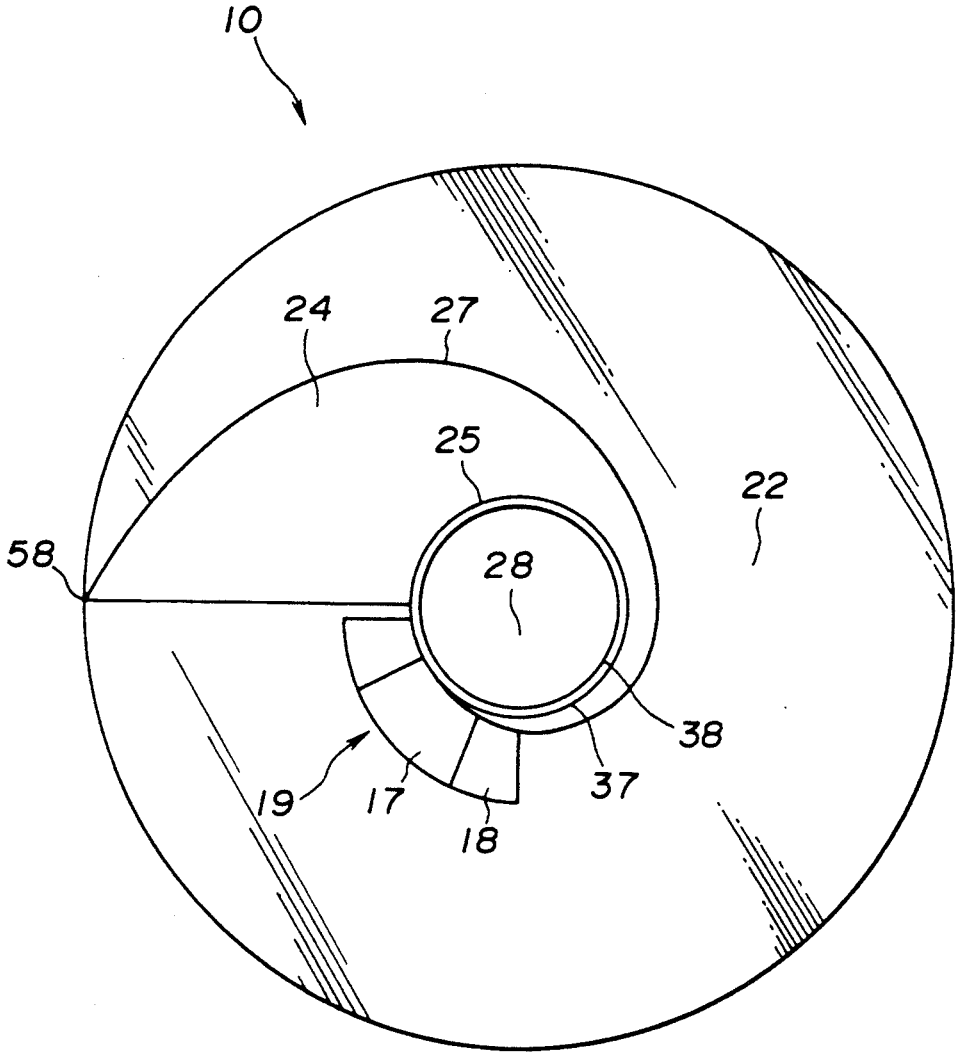
FIG. 13 is a plan view showing modification of the first rotating disk to be employed in the preferred embodiment of the coin dispensing mechanism.

FIG. 13 shows the modified construction of the first rotating disk 20 to be employed in the preferred embodiment of the coin dispensing mechanism 10. The illustrated modification is characterized by wider area provided for the arcuate side wall 24 of the feeding member 22. As can be seen, the greatest radius at one terminating end of the arcuate side wall 24 is extended to place the outer edge 58 at the outer periphery 21 of the first rotating disk 20. This construction may assure sweeping of the loose coins 75 into the coin feed aperture 28. In addition, by providing an expanded diameter for the coin feed aperture 28, the illustrated construction may permit to dispense greater diameter coins.

Figure 14:
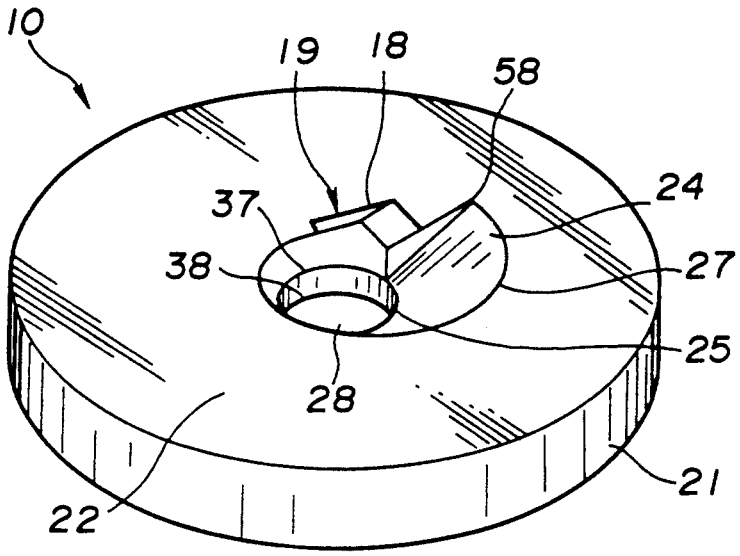
FIG. 14 is a perspective view of another modification of the first rotating disk to be employed in the preferred embodiment of the coin dispensing mechanism.
Figure 15:
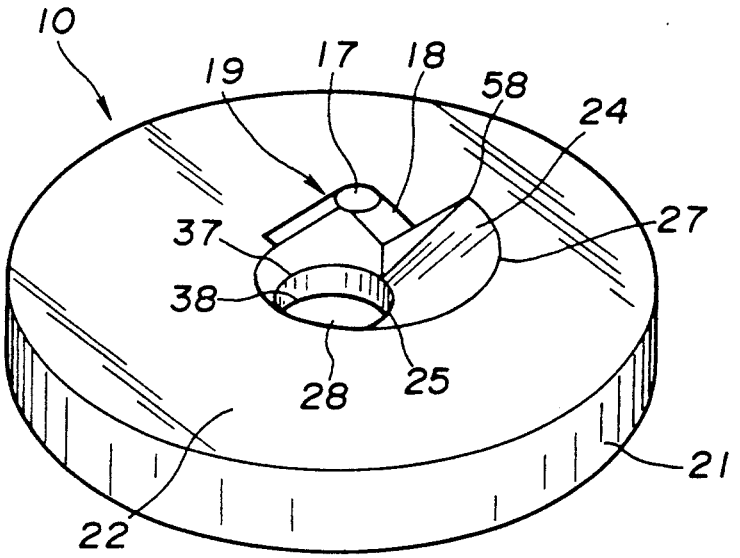
FIG. 15 is a perspective view of a further modification of the first rotating disk to be employed in the preferred embodiment of the coin dispensing mechanism.
Figure 16:
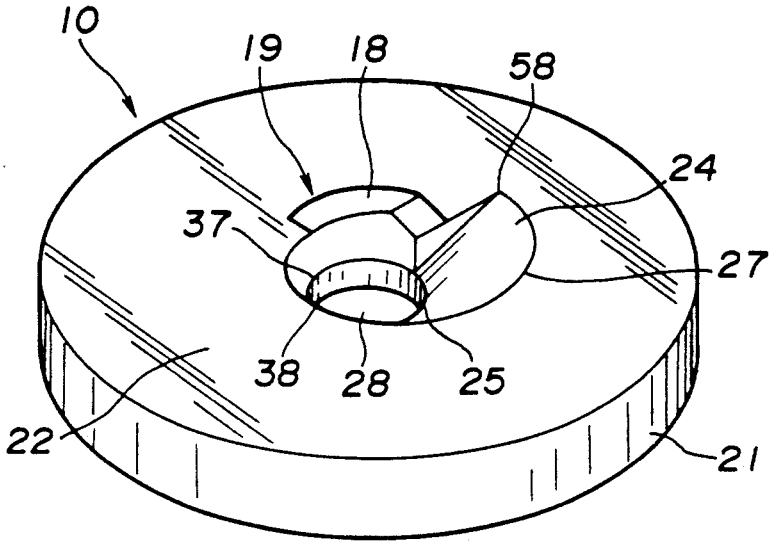
FIG. 16 is a perspective view of a still further modification of the first rotating disk to be employed in the preferred embodiment of the coin dispensing mechanism.

FIGS. 14, 15 and 16 show further modifications of the first rotating disks 20, in which the construction of the arcuate projections 19 are modified. In the modifications of FIGS. 14 and 16, the projections 19 are formed only by the tapered portions 18 without providing the plane portion. On the other hand, the modification of FIG. 15 includes reduced area of the plane portion 17 with the expanded circumferential length of the tapered portions 18. These constructions of the arcuate projections 19 may exhibit substantially the equivalent coin jamming preventive effect to that performed by the arcuate projection 19 in the foregoing preferred embodiment.

Figure 17:
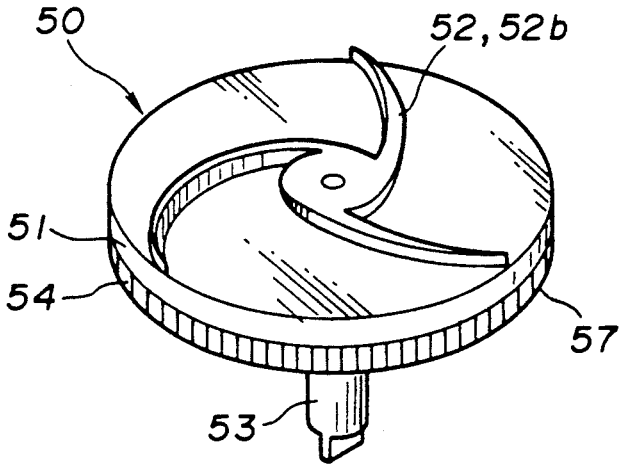
FIG. 17 is a plan view showing modification of the second rotating disk to be employed in the preferred embodiment of the coin dispensing mechanism.

FIG. 17 shows the modification of the second rotating disk 50. The illustrated modification is characterized by a modified configuration of the pushing means 52. Namely, in the illustrated modification, the pushing means 52 comprises one or more radially extending projecting strips 52*a* instead of the cylindrical pushing pin 52*a* in the preferred embodiment as discussed above. As can be seen, the projecting strip 52*a* is preferred in slightly curved configuration relative to the radial line. The curvature of the projecting strip 52*a* may be selected so that the pushing force exerted for the innermost coin 75 in the coin train aligned in the dispensing slot 46 may act in the direction substantially parallel to the feed direction of the coin.

With the shown constructions as set forth above, since the arcuate side wall 24 of the feeding member 22 is tilted toward the central feed aperture 28, and the width of the side wall 24 is gradually reduced with increasing of the tilt angle, the loose coins 75 on the first rotating disk 20 can be constantly agitated during every cycle of rotations of the first rotating disks for assuring prevention of jamming of the coins. For this, the arcuate projection 19 contributes distribution of the coins over the upper surface of the first rotating disk 20 and thus aids in preventing the coins from causing jamming. Therefore, smooth rotation of the first rotating disk 20 can be assured.

In addition, since the tapered inner periphery is provided for the central feed aperture 28, the coin falling therethrough into the dispensing slot 46 can be certainly oriented in the horizontal position to assure preventing the coin from staying in the central feed aperture 28 in the vertical condition, which makes the coin dispensing mechanism inoperative.

In addition, as can be appreciated from the modification of FIG. 13, by varying the maximum radial length of the arcuate side wall 24 of the feeding member 22, the preferred embodiment of the coin dispensing mechanism 10 can handle various sizes of coins.

Furthermore, according to the illustrated construction, since the pushing means 52 for pushing the innermost coin 75 toward the coin outlet slot 60 is stationary relative to the second rotating disk 50, the coin train in the dispensing slot 46 is certainly fed toward the coin outlet slot 60. On the other hand, since the upper plane 51 which carries the pushing means 52 is coupled with the lower plate 54 through a resilient coupling means, i.e. the waving washer 56, the upper plate 51 and the lower plate 54 are decoupled when the relatively large driving torque overcoming the resilient force of the resilient coupling means, is exerted. This prevents the motor from being overloaded.

While the present invention has been discussed in terms of the preferred embodiment of the present invention, it is obvious to those skilled in the art that various modifications, changes, and addition or omission of elements is possible for the disclosed construction in the actual implementation of the present invention, without departing from the principle of the invention. Therefore, it should be appreciated that the present invention should be understood to include all possible modifications with can be embodied without departing from the principle of the invention which may be defined in the appended claims.

For example, the arcuate projection employed in the first rotating disk may not be limited to the illustrated configurations but can be of any appropriate configurations. Also, the configuration of the pushing means is not limited to the illustrated configurations but can be of any appropriate configurations.

What is claimed is:

1. A coin dispensing device comprising:

means for storing loose coins;

first rotary means associated with a central feed aperture for receiving a loose coin from said loose coin storing means and feeding the loose coin into said central feed aperture so that coins are fed one-by-one;

stationary means for defining an elongated slot associated with said central feed aperture essentially at the inner end thereof for receiving the loose coin fed therethrough, said elongated slot forming a dispensing path for the loose coins fed from said central feed aperture;

second rotary means for pushing out the loose coins in said elongated slot toward a dispensing outlet, said second rotary means carrying pushing means movable across said elongated slot for exerting feeding force to the loose coin within said elongated slot for pushing out the coin within said elongated slot one-by-one;

driving means for rotatingly driving said first and second rotary means; and feed means incorporated in said first rotary means for sweeping the loose coins on said first rotary means into said central feed aperture, said feed means including an arcuate and tapered side wall having radial dimension progressively varying from a first circumferential end having the maximum radial dimension to a second circumferential end having the minimum radial dimension, the taper angle down toward said central feed aperture being increased from said first end to said second end, so that the loose coin is scooped at a position in the vicinity of said first circumferential end substantially in a one-by-one basis and fed toward the central feed aperture by the progressively increasing taper angle of said tapered side wall.

2. A coin dispensing device as set forth in claim 1, wherein projection means is provided on the surface of said first rotary means receiving thereon the loose coins, said projection means being positioned in the vicinity of said first end of said side wall for agitating the coins for preventing the coins from causing jamming.

3. A coin dispensing device as set forth in claim 1, wherein said center feed aperture has a tapered inner periphery narrowing toward the end opening to said elongated slot.

4. A coin dispensing device as set forth in claim 1, wherein said side wall substantially extends over the periphery of said central feed aperture to the outer periphery of said first rotary means, at said first end.

5. A coin dispensing device as set forth in claim 1, wherein said side wall substantially extends over the periphery of said central feed aperture to the position located in the vicinity of the outer periphery of said first rotary means, at said first end.

6. A coin dispensing device as set forth in claim 1, wherein said pushing means is stationary relative to said second rotary means.

7. A coin dispensing device as set forth in claim 6, wherein said pushing means comprises at least one projecting pin projected from said second rotary means.

8. A coin dispensing device as set forth in claim 6, wherein said pushing means comprises at least one bar-shaped piece projecting from said second rotary means and extending essentially in a radial direction.

9. A coin dispensing device as set forth in claim 1, wherein said second rotary means comprises a first rotary member carrying said pushing means, a second rotary member associated with said driving means to be driven by the driving torque supplied therefrom, and a load responsive clutch means disclosed between said first and second rotary members for normally coupling therebetween for co-rotation and responsive to a load higher than a predetermined value for decoupling therebetween.

10. A coin dispensing device comprising:

a coin hopper for storing loose coins therein, said coin hopper defining a bottom opening for supplying the loose coins therethrough;

a first rotating disk disposed beneath said bottom opening of said coin hopper, said first rotating disk having an upper surface for receiving a plurality of loose coins supplied through said bottom opening of said coin hopper, said first rotating disk defining a central feed aperture extending substantially in a vertical direction for passing the loose coins therethrough, said first rotating disk further defining a tapered surface extending in a circumferential direction and descending toward said central feed aperture in a part of said upper surface, said tapered surface being terminated with a vertically extending section at one end so that the loose coins are scooped at a position in the vicinity of an outermost end portion of said tapered surface so that the loose coins are fed substantially one-by-one toward the central feed aperture by the progressively increasing descending angle of said tapered surface;

a fixed disk having an upper surface defining a horizontally extending coin dispensing path which as the inner end opposing a lower end of said central feed aperture of said first rotating disk and an outer end opening to a coin dispensing outlet;

a second rotating disk located beneath said fixed disk and carrying at least one pushing member travelling across said coin dispensing path defined in said fixed disk for exerting feeding force to a loose coin therein for feeding toward said coin dispensing outlet; and a driving means for rotatingly driving said first and second rotating disk.

11. A coin dispensing device as set forth in claim 10, wherein said tapered surface of said first rotating disk is variable of the taper angle relative to the horizontal place so that the taper angle is increased from said one end to the other end.

12. A coin dispensing device as set forth in claim 11, wherein said the other end of said tapered surface is substantially continuous to an inner periphery of said center feed aperture.

13. A coin dispensing device as set forth in claim 12, wherein said center feed aperture has the tapered inner periphery to have the largest diameter at the upper end and the smallest diameter at the lower end.

14. A coin dispensing device as set forth in claim 10, which further comprises a projection defined in said upper surface of said first rotating disk, said projection having at least one sloped surface oriented in the circumferential direction.

15. A coin dispensing device as set forth in claim 14, wherein said projection is radially positioned in the vicinity of the peripheral edge of said center feed aperture.

16. A coin dispensing device as set forth in claim 14, wherein said projection is positioned in the vicinity of said one end of said tapered surface.

17. A coin dispensing device as set forth in claim 16, wherein said projection directs said sloped surface to said one end of said tapered surface so that said sloped surface of said projection terminates at the upper edge of said vertical section.

18. A coin dispensing device as set forth in claim 10, wherein said pushing member is rigidly fixed to said second member for rotation therewith.

19. A coin dispensing device as set forth in claim 10, wherein said second rotating disk comprises a first upper disk carrying said pushing member rigidly fixed thereto, a second lower disk coupled with said driving means to be rotatingly driven by the driving torque transmitted therefrom, and a mechanical clutch disposed between said first upper and second lower disks for normally coupling therebetween for co-rotation and responsive to an excess load exerted on said first upper disk to decouple said first upper and second lower disk to permit slipping rotation of said second lower disk relative to said first upper disk.

20. A coin dispensing device as set forth in claim 19, wherein said mechanical clutch comprises a waving washer disposed between said first upper and second lower disks, which establishes frictional engagement therebetween.

21. A coin dispensing device comprising:

a coin hopper for storing loose coins therein, said coin hopper defining a bottom opening for supplying the loose coins therethrough;

a first rotating disk disposed beneath said bottom opening of said coin hopper, said first rotating disk having an upper surface for receiving a plurality of loose coins supplied through said bottom opening of said coin hopper, said first rotating disk defining a central feed aperture extending substantially in a vertical direction for passing the loose coins therethrough;

a fixed disk having an upper surface defining a horizontally extending coin dispensing path which has an inner end opposing to a lower end of said central feed aperture of said first rotating disk and an outer end opening to a coin dispensing outlet;

a second rotating disk located beneath said fixed disk and carrying at least one pushing member rigidly fixed thereon and travelling across said coin dispensing path defined in said fixed disk for exerting feeding force to a loose coin therein for feeding toward the coin dispensing outlet, said second rotating disk including a first upper disk carrying said pushing member rigidly fixed thereto, a second lower disk coupled with said driving means to be rotatingly driven by the driving torque transmitted therefrom, and a mechanical clutch disposed between said first upper and second lower disks for normally coupling therebetween for co-rotation and responsive to an excess load exerted on said second lower disk to decouple said first upper and second lower disk to permit slipping rotation of said first upper disk relative to said second lower disk; and driving means for rotatingly driving said first and second rotating disk.

22. A coin dispensing device comprising:

a coin hopper for storing loose coins therein, said coin hopper defining a bottom opening for supplying the loose coins therethrough;

a first rotating disk disposed beneath said bottom opening of said coin hopper, said first rotating disk having an upper surface for receiving a plurality of loose coins supplied through said bottom opening of said coin hopper, said first rotating disk defining a central feed aperture extending substantially in a vertical direction for passing the loose coin therethrough, said first rotating disk further defining a tapered surface extending in a circumferential direction and descending toward said central feed aperture in a part of said upper surface, said tapered surface being terminated with a vertically extending section at one end, so that a loose coin is scooped at a position in the vicinity of an outermost end portion of said tapered surface so that coins are fed substantially one-by-one toward the central feed aperture by the progressively increasing descending angle of said tapered surface;

a fixed disk having an upper surface defining a horizontally extending coin dispensing path which has an inner end opposing a lower end of said central feed aperture of said first rotating disk and the outer end opening to a coin dispensing outlet;

a second rotating disk located beneath said fixed disk and carrying at least one pushing member rigidly fixed thereon and travelling across said coin dispensing path defined in said fixed disk for exerting feeding force to the loose coin therein for feeding toward the coin dispensing outlet, said second rotating disk including a first upper disk carrying said pushing member rigidly fixed thereto, a second lower disk coupled with said driving means to be rotatingly driven by the driving torque transmitted therefrom, and a mechanical clutch disposed between said first upper and second lower disks for normally coupling therebetween for co-rotation and responsive to an excess load exerted on said second lower disk to decoupled said first upper and second lower disk to permit slipping rotation of said first upper disk relative to said second lower disk; and driving means for rotatingly driving said first and second rotating disk.

* * * * *